US005549249A

United States Patent [19]

Foster et al.

[11] Patent Number: 5,549,249

[45] Date of Patent: Aug. 27, 1996

[54] FLUID SPINNER AND NOZZLE HEAD ASSEMBLY WITH CONTROLLED FLUID FLOOD PATH

[75] Inventors: Donald D. Foster, St. Charles; Philip L. Nelson, Ellisville, both of Mo.

[73] Assignee: Contico International, Inc., St. Louis, Mo.

[21] Appl. No.: 230,494

[22] Filed: Apr. 20, 1994

Related U.S. Application Data

[63] Continuation-in-part of Ser. No. 808,168, Dec. 13, 1991, Pat. No. 5,368,234.

[51] Int. Cl.[6] ..... B05B 9/043; B05B 1/34

[52] U.S. Cl. ..... 239/463; 239/493; 239/526

[58] Field of Search ..... 239/333, 330, 239/600, 468, 492, 491, 493.4; 222/380, 383

[56] References Cited

U.S. PATENT DOCUMENTS

| | | | |
|---|---|---|---|
| 4,153,203 | 5/1979 | Tada . | |
| 4,230,277 | 10/1980 | Tada . | |
| 4,273,290 | 6/1981 | Quinn | 239/333 X |
| 4,365,751 | 12/1982 | Saito et al. . | |
| 4,480,768 | 11/1984 | Martin . | |
| 4,503,998 | 3/1985 | Martin . | |
| 4,527,594 | 7/1985 | Garneau . | |
| 4,527,741 | 7/1985 | Garneau . | |
| 4,624,413 | 11/1986 | Corsette . | |
| 4,706,888 | 11/1987 | Dobbs . | |
| 4,815,663 | 3/1989 | Tada . | |
| 4,911,361 | 3/1990 | Tada . | |
| 4,940,186 | 7/1990 | Tada . | |
| 4,953,791 | 9/1990 | Tada . | |
| 4,958,754 | 9/1990 | Dennis . | |
| 4,989,790 | 2/1991 | Martin et al. . | |
| 5,228,600 | 7/1993 | Steijns et al. . | |
| 5,234,166 | 8/1993 | Foster et al. . | |
| 5,267,692 | 12/1993 | Maas et al. . | |
| 5,368,234 | 11/1994 | Foster et al. . | |

FOREIGN PATENT DOCUMENTS

| | | | |
|---|---|---|---|
| 117898 | 10/1983 | European Pat. Off. | 239/333 |
| 0221237 | 5/1987 | European Pat. Off. . | |
| 60-183056 | 9/1985 | Japan . | |
| 60-44023 | 10/1985 | Japan . | |
| 2143286 | 2/1985 | United Kingdom . | |

*Primary Examiner*—Kevin P. Weldon
*Attorney, Agent, or Firm*—Howell & Haferkamp, L.C.

[57] ABSTRACT

The construction of a nozzle head for a trigger sprayer apparatus and the constructions of several variant embodiments of fluid spinners that are assembled into the nozzle head facilitate the assembly of the spinners into the nozzle head with fluid swirl chambers of the spinners centered relative to a fluid discharge orifice of the nozzle head. The swirl chamber of each spinner assembly is surrounded by an annular wall and the end face of the annular wall engages against a flat orifice wall surrounding the sprayer discharge orifice thereby sealing the swirl chamber around the orifice. Tangential grooves through the annular wall provide the only path of fluid flow into the swirl chamber.

38 Claims, 2 Drawing Sheets

FLUID SPINNER AND NOZZLE HEAD ASSEMBLY WITH CONTROLLED FLUID FLOOD PATH

This is a continuation-in-part application of U.S. patent application Ser. No. 07/808,168, filed Dec. 13, 1991 and now U.S. Pat. No. 5,368,234.

BACKGROUND OF THE INVENTION (1) Field of the Invention

The present invention pertains to the construction of a nozzle head for a trigger sprayer apparatus and the constructions of several variant embodiments of fluid spinners that are assembled into the nozzle head. In particular, the nozzle head and the variant embodiments of fluid spinners are constructed to facilitate the assembly of the spinners into the nozzle head with fluid swirl chambers of the spinners centered relative to a fluid discharge orifice of the nozzle head.

(2) Description of the Related Art

There are many known fluid trigger sprayer apparatus that position a fluid discharge orifice at an outlet end of a fluid conducting channel of the sprayer apparatus to obtain a desirable pattern of sprayer from the apparatus. One of the more simplified constructions comprises a nozzle head that carries a fluid discharge orifice and is assembled directly to a fluid channel outlet opening of a sprayer apparatus. An example of this type of trigger sprayer apparatus is disclosed in U.S. Pat. No. 4,958,754, assigned to the assignee of the present invention and incorporated herein by reference.

Trigger sprayers of this type typically include a sprayer housing with a fluid discharge channel extending through the housing from a fluid inlet opening at an upstream end of the channel to a fluid outlet opening at a downstream end of the channel. A nozzle head is assembled into the outlet opening at the downstream end of the fluid channel.

The nozzle head typically includes an orifice wall with a fluid discharge orifice extending therethrough. A cylindrical fluid conduit surrounds the orifice on one side of the orifice wall and projects outwardly from the orifice wall with a center bore of the conduit aligned coaxially with the fluid discharge orifice.

In assembling the nozzle head to the sprayer housing, the nozzle head conduit is inserted through the fluid outlet opening at the downstream end of the sprayer housing fluid channel, thereby coaxially aligning the nozzle head conduit bore and fluid discharge orifice with the fluid channel of the sprayer housing. However, before the nozzle head conduit is inserted into the outlet opening of the sprayer housing Channel, a fluid spinner is inserted into the interior bore of the nozzle head conduit.

The typical fluid spinner is formed with a biasing spring at its middle, a spinner head at one end of the spring and a valve member at the opposite end of the spring. The spinner head is formed with a cylindrical swirl chamber surrounded by an annular wall having a pair of tangential Grooves extending therethrough. The Grooves and swirl chamber impart a spin to fluid passed through the swirl chamber prior to its being discharged through the nozzle head orifice. In order for the fluid spinner to operate most effectively in imparting a rotation to fluid, the annular wall surrounding the swirl chamber of the spinner must be centered relative to the discharge orifice of the nozzle head and must seat in a sealing engagement with the nozzle head so that the fluid entering the swirl chamber enters only through the tangential grooves of the spinner assembly annular wall. This creates the optimum spin in the fluid prior to its passing through the discharge orifice to produce the desired spray pattern of the discharged fluid.

Any fluid entering the swirl chamber by bypassing the tangential grooves of the spinner assembly annular wall will disrupt the swirl pattern of fluid in the swirl chamber and prevent the trigger sprayer apparatus from dispensing fluid from the discharge orifice in the optimum spray pattern. In order to provide a seal of the swirl chamber annular wall around the discharge orifice and to center the swirl chamber relative to the orifice, prior art nozzle heads were provided with annular recesses in their orifice walls surrounding the discharge orifice. The recesses were dimensioned to receive the distal end of the swirl chamber annular wall and provide a friction sealing engagement between the side walls of the annular recess and the interior and exterior surfaces of the swirl chamber annular wall.

However, in assembling a spinner assembly into the nozzle head conduit with the spinner swirl chamber centered relative to the discharge orifice, it is often difficult to exert sufficient force on the spinner assembly to achieve the required sealing engagement between the interior and exterior surfaces of the swirl chamber annular wall and the interior and exterior surfaces of the recessed annular slot formed in the nozzle head orifice wall. This is primarily due to the resiliency of the spinner assembly spring which is used to exert a force on the head of the spinner assembly pressing the annular wall of the swirl chamber into sealing engagement inside the annular recess of the nozzle orifice wall. Often in assembling the spinner assembly into the nozzle head conduit, particularly where the assembly is performed mechanically and not manually, the annular wall of the spinner swirl chamber will not seat in its proper sealing engagement due to the spinner assembly spring's inability to exert a directed force on the spinner head, resulting in the spinner assembly being improperly assembled into the conduit of the nozzle head without creating the proper sealing of the spinner swirl chamber.

SUMMARY OF THE INVENTION

The present invention overcomes disadvantages of prior art trigger sprayer apparatus of the type set forth above by providing a nozzle head assembly and a fluid spinner assembly that are easily assembled together with a swirl chamber of the spinner assembly sealed and centered relative to a discharge orifice of the nozzle head.

The nozzle head is constructed with a small projection from its orifice wall surrounding the entrance of the fluid discharge orifice in the orifice wall. In one embodiment of the invention employing a spinner assembly having a biasing spring, the projection has a circumference dimensioned slightly smaller than an interior circumference of the annular wall of the spinner swirl chamber enabling the projection to fit easily inside the swirl chamber annular wall and thereby center the swirl chamber around the entrance to the discharge orifice. In order to achieve a sealing engagement between the annular wall of the spinner and the nozzle head assembly, both the nozzle head orifice wall surrounding the projection and the distal end face of the swirl chamber annular wall are formed flat so that the end face of the annular wall will seat in sealing engagement against the nozzle head orifice wall surrounding the fluid discharge orifice. With this sealing engagement between the nozzle orifice wall and the spinner swirl chamber wall, the only fluid to enter the swirl chamber passes through the tangential slots of the swirl chamber annular wall.

The fluid conduit projecting from the nozzle head orifice wall has a cylindrical interior bore dimensioned slightly larger than the cylindrical exterior surface of the spinner swirl chamber annular wall. This serves to guide the swirl chamber annular wall as it is inserted through the conduit bore in assembling the spinner to the nozzle head, and insures that the swirl chamber annular wall is centered relative to and properly fits around the projection on the nozzle head orifice wall.

The spinner of the invention employed with the nozzle head of the invention is also provided in two variant embodiments. These embodiments include a spinner comprising a disk or diaphragm valve connected to the spinner head by an elongated stem, and a two piece spinner having spines projecting from the spinner for securing the spinner head in the nozzle head conduit and having a separate disk or diaphragm valve held securely in the sprayer housing fluid channel adjacent the channel inlet opening. Because these two embodiments employ a rigid stem in lieu of the biasing spring to urge the spinner head in sealing engagement with the orifice wall, the stem can be used in assembling the spinner assembly into sealing engagement in the nozzle head conduit. In these embodiments the interior diameter of the swirl chamber annular wall is slightly smaller than the exterior diameter of the orifice wall projection, thereby providing an interference fit of the annular wall around the orifice wall projection.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
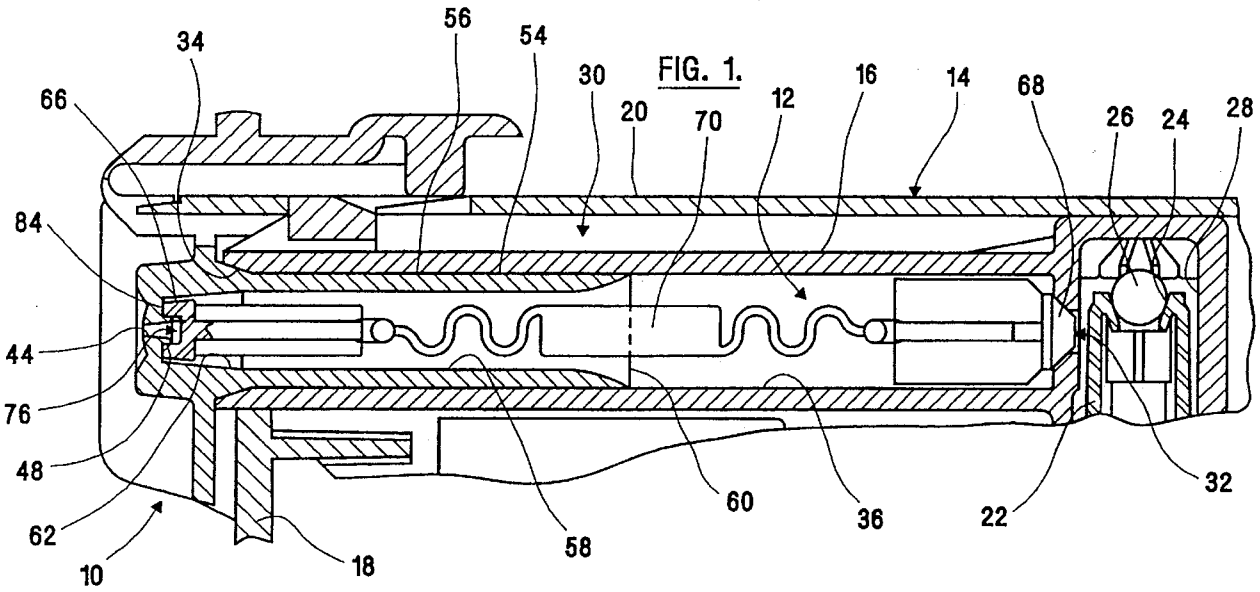
FIG. 1 is a partial side view, in section, of the sprayer housing of a trigger sprayer apparatus having the nozzle head of the invention and the first embodiment of the fluid spinner of the present invention assembled thereto.

FIG. 1 shows the nozzle head 10 and fluid spinner 12 of the present invention assembled to a conventional trigger sprayer apparatus 14 of the type disclosed in U.S. Pat. No. 4,958,754, assigned to the assignee of the present invention and incorporated herein by referenced. Generally, the portions of the trigger sprayer apparatus 14 shown in FIG. 1 include the sprayer housing 16 having the manually operated trigger 18 attached thereto for pivoting movement, and a covering shroud 20 assembled over the housing.

Contained inside the sprayer housing 16 is a tubular vertical riser 22 shown at the right hand side of FIG. 1. The lower end of the riser communicates with a dip tube (not shown) that extends downward and is submerged in the liquid contained in the container (not shown) to which the fluid trigger sprayer apparatus 14 is attached. As seen in FIG. 1, the upper end of the riser 22 is formed with a valve seat 24 on which rests a ball valve 26. The riser 22 is contained in a vertical fluid conducting column 28 of the sprayer housing 16 that surrounds the riser. The column 28 in turn is connected in fluid communication with a fluid conducting channel 30 extending through the sprayer housing 16 from an inlet opening 32 adjacent the fluid column 28 to an outlet opening 34 at a distal end of the channel. The bore of the fluid channel 30 is surrounded by a cylindrical interior channel surface 36 of the sprayer housing 16. The cylindrical interior surface 36 is coaxial with the channel inlet and outlet openings 32, 34. The inlet opening 32 of the fluid channel 30 is circular and has a generally tapered interior surface which is specifically configured to serve as a valve seat for the valve of the fluid spinner 12. The outlet opening 34 of the fluid channel is also circular and has a diameter dimensioned to receive a conduit of the nozzle head 10 yet to be described.

The functioning of the sprayer housing 16 is conventional. In response to manual reciprocating movements of the trigger 18, fluid is pumped from the container (not shown) up through the interior of the vertical riser 22. The fluid displaces the ball valve 26 from its seat 24, filling the space between the exterior of the riser 24 and the interior of the housing vertical column 28 as well as the interior of the fluid pump chamber (not shown). On continued reciprocation of the trigger 18, the fluid filling the pump chamber and the space between the riser 22 and column 28 exerts a pressure force against the fluid spinner valve head displacing the valve head from the valve seat 32 and the fluid is pumped through the fluid channel from the inlet opening 32 to the outlet opening 34.

The nozzle head 10 of the invention is shown on the left hand side of FIG. 1 assembled to the sprayer housing. The nozzle head is comprised of an orifice wall 42 that carries the fluid discharge orifice 44 of the trigger sprayer. Fluid pumped through the sprayer housing channel 30 is sprayed from the orifice. The orifice 44 is centered in a cylindrical projection 48 that extends from the interior surface 50 of the orifice wall to a face surface 49 of the projection positioned in the bore of the sprayer fluid channel 30. The cylindrical projection 48 and the discharge orifice 44 of the nozzle head are both coaxial with the sprayer housing channel 30.

Figure 4:
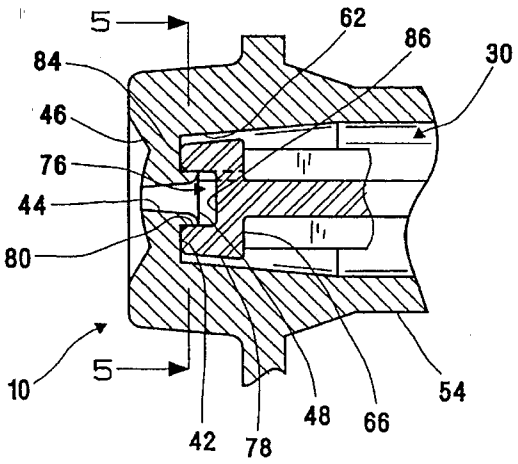
FIG. 4 is a partial side view, in section, of the detail of the nozzle head and fluid spinner of the present invention.

A conduit 54 also projects from the interior surface 50 of the nozzle head orifice wall. The conduit extends through the outlet opening 34 of the fluid channel into the channel interior bore. The nozzle head conduit 54 has a cylindrical exterior surface dimensioned to fit in friction engagement against the channel interior surface 36. The head conduit 54 also has a generally cylindrical interior surface 58 that extends from the orifice wall 50 to the distal end 60 of the conduit. A portion of the conduit interior surface 62 adjacent the orifice wall 42 tapers as it extends toward the orifice wall as best seen in FIG. 4. This tapered portion 62 of the interior surface serves to center the swirl chamber of the fluid spinner 12 as it is assembled into the nozzle head conduit 54 as will be explained.

The interior surface 50 of the orifice wall surrounds the projection 48 and presents a flat surface perpendicular to the center axis of the orifice 44 as it extends radially from the periphery of the orifice projection 48 to the interior surface 62 of the nozzle head conduit.

The nozzle head 10 also includes a sealing door 66 connected by a living hinge 68 to the top of the nozzle head. The door 66 functions in the same manner as sealing doors of conventional trigger sprayer apparatus.

A first embodiment of the fluid spinner 12 of the invention is shown in FIG. 1. As in conventional fluid spinners, the spinner of the invention is comprised of a spinner head 66 and a valve 68 connected by an intermediate spring 70. The valve 68 seats in the valve seat at the inlet opening 32 of the sprayer housing fluid channel 30 and is held in this position by the bias of the intermediate spring 70 until the pressure of the fluid pumped to the channel inlet 32 unseats the valve. The spring 70 also biases the spinner head 66 into engagement against the orifice wall 42 of the nozzle head. The novel configuration of the spinner head 66 facilitates its assembly into the interior of the nozzle head conduit 54 and provides its sealing engagement with the orifice wall 42 of the nozzle head.

Figure 5:
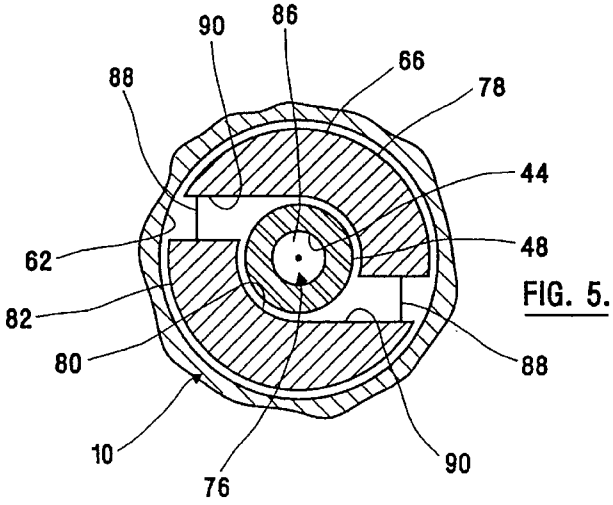
FIG. 5 is a partial end view, in section, taken along the line 5—5 of FIG. 4.

As best seen in FIGS. 4 and 5, the spinner head 66 is formed with a swirl chamber 76 at its distal end. The swirl chamber 76 has a cylindrical configuration surrounded by a cylindrical annular wall 78. The annular wall 78 has an interior surface 80 surrounding the swirl chamber and an exterior surface 82. An annular end face 84 extends between the annular wall interior surface 80 and exterior surface 82. A circular end wall 86 of the swirl chamber is recessed an axial distance into the swirl chamber 76 from the wall end face 84. At least a pair of axial grooves 88 are formed into the exterior surface 82 of the annular wall, and a pair of tangential grooves 90 extend from the axial grooves 88 through the annular wall to the swirl chamber 76.

Together, the tangential grooves and swirl chamber act to impart rotation to fluid passed from the sprayer housing channel 30 through the grooves and swirl chamber and out through the nozzle head orifice, imparting a spray pattern to the fluid discharged from the orifice. However, in order to achieve an optimum pattern of fluid spray from the nozzle head orifice 44, the fluid pumped through the sprayer housing channel 30 into the swirl chamber 76 must enter the chamber only through the tangential grooves 90. Therefore, the swirl chamber 76 must be perfectly sealed around the nozzle head orifice 44 so that fluid only enters the swirl chamber through the tangential grooves 90.

The configuration of the nozzle head 10 of the invention and the spinner head 66 of the fluid spinner 12 of the invention enables the spinner to be easily assembled into the nozzle head conduit 54 with the swirl chamber properly sealed and centered relative to the discharge orifice 44. The exterior surface of the swirl chamber annular wall 82 has a circumference dimensioned slightly smaller than the smallest circumference of the tapering portion 62 of the sprayer housing channel 30 so that it may be easily inserted through the interior of the channel from the channel distal end 60 to the orifice wall interior surface 50. The interior surface 80 of the swirl chamber annular wall has a circumferential measure and a diameter slightly larger than that of the cylindrical projection 48 surrounding the discharge orifice 44 of the nozzle head. With these relative dimensions of the fluid spinner head 66 and the nozzle head 10, the fluid spinner head may be easily inserted through the nozzle head conduit 54 with the tapered end portion 62 of the conduit directing the annular wall 78 of the spinner head swirl chamber around the circumference of the orifice wall projection 48 centering the swirl chamber 78 relative to the discharge orifice 44. In assembling the fluid spinner 12 in the nozzle head conduit 54, the flat end face 84 of the swirl chamber annular wall sits in sealing engagement against the flat interior surface 50 of the nozzle head orifice wall. The sole sealing engagement between the swirl chamber annular wall 78 and the nozzle head 10 is between the annular wall end face 84 and the interior surface 50 of the nozzle head orifice wall.

Because there is a clearance or tolerance provided between the circumference of the orifice wall projection 48 and the interior surface of the swirl chamber annular wall 80 and because there is a clearance provided between the interior surface of the tapered portion 62 of the nozzle head conduit and the exterior surface of the swirl chamber annular wall 82, the spinner assembly 12 may be easily assembled into the nozzle head conduit 54 by gripping the spring portion 70 of the spinner and inserting the spinner head 66 through the conduit from its distal end 60 until the annular end face 84 of the spinner swirl chamber engages in sealing engagement against the interior surface 50 of the nozzle head orifice wall. Because of the clearances provided, it is not necessary to exert a pushing force on the spring 70 in order to obtain sealing engagement of the spinner annular wall 82 around the orifice 44 as it is in prior art trigger sprayers.

Figure 2:
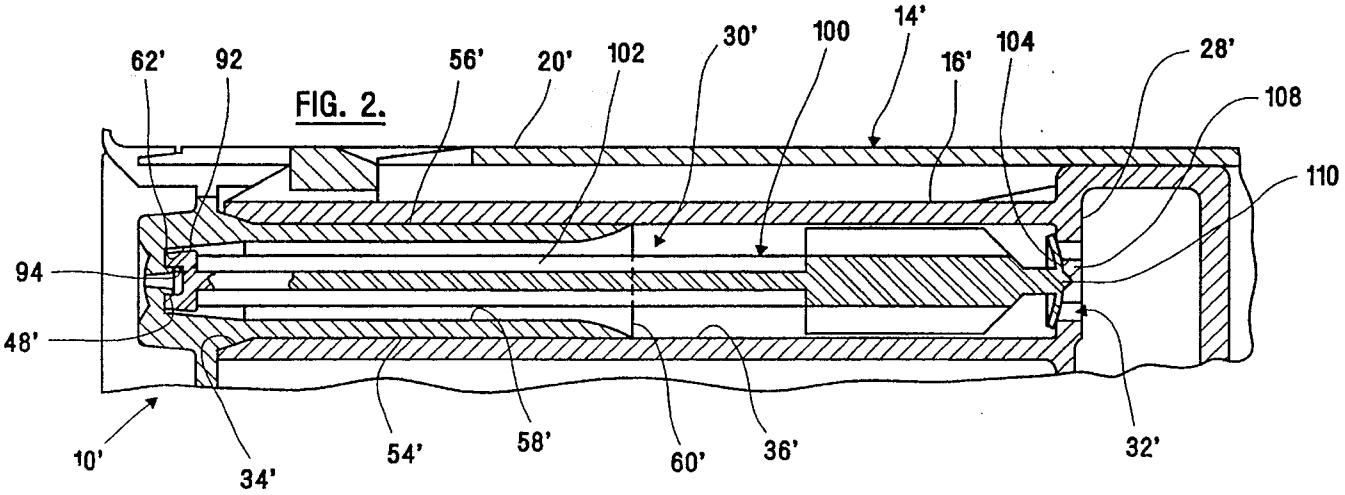
FIG. 2 is a partial side view, in section, of the sprayer housing and nozzle head of FIG. 1 showing a variant of the fluid spinner of the present invention.
Figure 3:
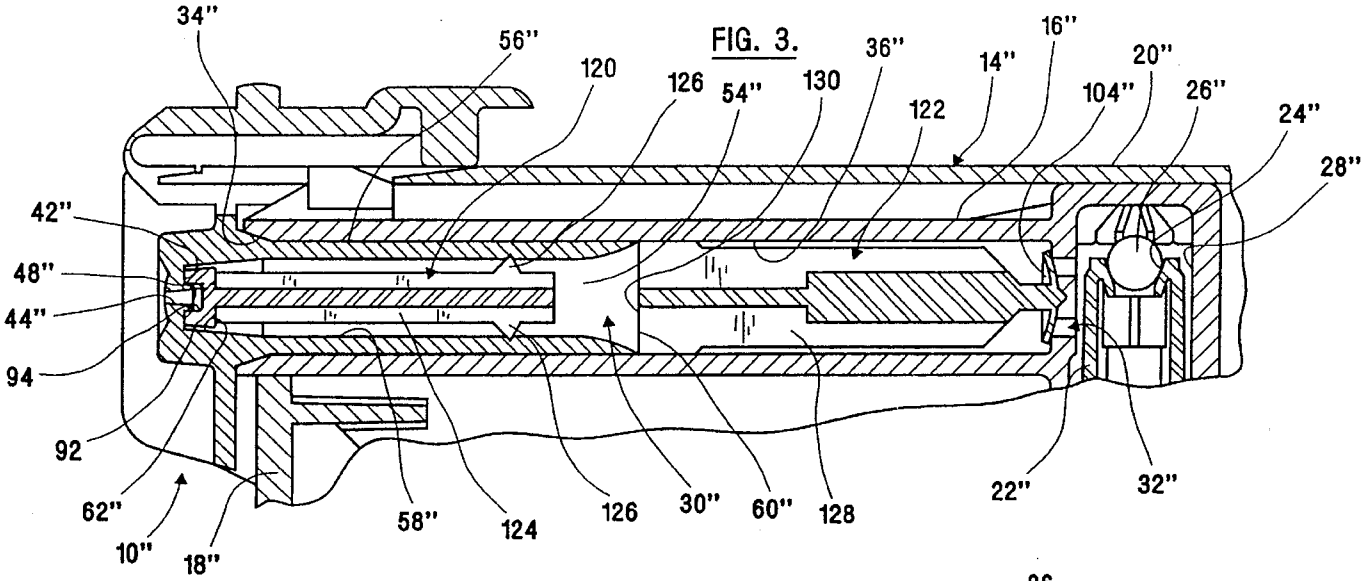
FIG. 3 is a partial side view, in section, of the sprayer housing and nozzle head of FIG. 1 and also showing a third variant embodiment of the fluid spinner of the present invention.

FIGS. 2 and 3 show variant embodiments of the fluid spinner assembly of the present invention. The sprayer housings shown in FIGS. 2 and 3 are for the most part identical to that shown in FIG. 1 and the same reference numerals followed by a prime (') in FIG. 2 and a double prime (") in FIG. 3 are employed to identify the component parts of the sprayer housings that are the same as those of the sprayer housing of FIG. 1. Moreover, the constructions of the spinner heads of both variant embodiments of the fluid spinner assembly shown in FIGS. 2 and 3 are for the most part identical to that of the fluid spinner 12 shown in FIG. 1 and described above except for the circumferential dimension or measure of the interior surface of the spinner head annular wall.

In both embodiments of the spinner assemblies shown in FIGS. 2 and 3 the spinner head 92 is constructed with a swirl chamber surrounded by an annular wall. The annular wall has a cylindrical interior surface surrounding the swirl chamber and a generally cylindrical but tapered exterior surface in the same manner as the spinner head of the first described embodiment of the fluid spinner 12. The spinner head 92 of the FIG. 2 and 3 embodiments also comprises a circular end wall at the right hand side of the swirl chamber as viewed in FIGS. 2 and 3 and an annular wall end face at the left hand distal end of the swirl chamber annular wall just as in the first described embodiment of the fluid spinner 12. A pair of axial grooves extends longitudinally through the exterior surface of the swirl chamber annular wall and a pair of tangential grooves extends through the annular wall from the axial grooves to the swirl chamber in the same manner as the first described fluid spinner. The only difference between the spinner head 92 of the second and third embodiments of the invention shown in FIGS. 2 and 3 respectively, is that the interior diameter of the annular wall interior surfaces 94 is slightly smaller than the exterior diameter of the nozzle head orifice projection 48', 48" in the FIG. 2 and 3 embodiments respectively, and the circumferential dimension or measure of the annular wall interior surface 94 of the FIG. 2 and 3 embodiments is slightly smaller than the exterior circumferential dimension or circumference of the nozzle head orifice projection 48', 48", respectively. The difference in the circumferences of the orifice wall projection and the annular wall interior surface of each of these embodiments produces a sealing, interference fit of the annular wall interior surface around the orifice wall projection as the spinner head 92 is assembled into the nozzle head conduit and onto the orifice projection. What is meant by an interference fit is that the material employed in constructing the nozzle head orifice projection and the spinner head, preferably a resilient plastic material, allows the mating surfaces of the orifice wall projection and the interior surface of the spinner head annular wall to compress slightly, thereby providing a sealed engagement between these two surfaces as the spinner head is assembled into the nozzle head conduit. This sealing, interference fit between these two surfaces is possible because a greater force can be transmitted through the more rigid stems of the two variant embodiments of the spinner assembly than is possible with a spinner assembly having an intermediate spring such as the embodiment of FIG. 1. With the variant embodiments of the spinner assembly shown in FIGS. 2 and 3, the spinner head annular wall interior surface engages in an interference fit sealing engagement around the circumference of the orifice projection and the annular wall end surface engages in sealing engagement with the orifice wall interior surface preventing fluid communication from the sprayer housing channel to the spinner swirl chamber except through the axial grooves and tangential grooves in the spinner head.

In the variant embodiment of the spinner assembly 100 shown in FIG. 2, the intermediate spring and valve of the first described embodiment of the fluid spinner are replaced by an elongated stem 102 and a disk or diaphragm valve 104. The spinner head 92, the elongated stem 102 and the disk valve 104 are integrally formed of the same material. At the sprayer housing inlet opening 32' communicating the vertical column 28' in fluid communication with the sprayer housing channel 30' a center abutment 108 is formed across the middle of the opening. The abutment 108 has a depression in its end face facing the sprayer housing channel 30' and a projection 110 at the center of the spinner disk valve 104 engages in the depression to hold the disk valve 104 in its proper centered position relative to the inlet opening. The axial length of the stem 102 causes the annular end face of the spinner head to seat in sealing engagement against the nozzle head orifice wall in the same manner as the first described embodiment of the fluid spinner, and also holds the disk valve 104 in sealing engagement against the valve seat at the inlet opening 32' of the sprayer housing fluid channel. The spinner assembly 100 is preferably constructed of a resilient plastic material that enables the disk valve 104 to flex slightly when subjected to increased fluid pressure at the inlet opening 32' due to reciprocating movement of the sprayer trigger (not shown in FIG. 2). This flexing or deformation of the disk valve 104 permits the fluid to pass through the inlet opening 32' and flow through the sprayer head fluid channel 30' for discharge of the fluid in a spray pattern from the nozzle head orifice in the same manner as the first described embodiment of the invention.

The embodiment of the fluid spinner assembly shown in FIG. 3 is assembled into a nozzle head 10" and sprayer housing 16" identical to that of the fluid spinner of FIG. 2 but the spinner assembly itself is comprised of a two piece construction. This third embodiment of the spinner assembly includes a first piece 120 having the spinner head 92 of the FIG. 2 embodiment of the fluid spinner and a second piece 122 having the disk valve 104" of the FIG. 2 embodiment of the fluid spinner.

On the first piece 120 of the spinner assembly, a stem 124 extends from the spinner head 92 through the interior of the nozzle head conduit 54". A pair of radially projecting spines 126 are provided at the distal end of the stem 124. The spines 126 engage into the interior surface of the nozzle head conduit 54" as the first piece of the spinner assembly 120 is assembled into the conduit and hold the annular end face of the spinner head 92 in sealing engagement against the nozzle head orifice wall 42".

The second piece of the spinner assembly 122 is also provided with a stem 128 that projects from the disk valve 104" through the sprayer housing channel 30" to a distal end 130 of the disk valve stem. As seen in FIG. 3, the distal end 130 of the disk valve stem is enlarged so that it engages against the interior surface of the sprayer housing channel 30" and abuts against the distal end 60" of the nozzle head conduit. The engagement of the valve stem with the nozzle head conduit holds the disk valve 104" in its proper seated position at the fluid channel inlet opening.

While the present invention has been described by reference to a specific embodiment, it should be understood that modifications and variations of the invention may be constructed without departing from the scope of the invention defined in the following claims.

What is claimed is:

1. A trigger sprayer comprising:

a sprayer housing having a fluid channel with a cylindrical interior surface extending axially therethrough, the channel having opposite first and second ends with a fluid outlet opening at the first end and a fluid inlet opening at the second end;

a nozzle head assembled to the first end of the sprayer housing, the nozzle head having an orifice wall with a fluid discharge orifice extending axially therethrough, a cylindrical conduit projecting from the orifice wall through the fluid channel outlet opening and into the fluid channel, the conduit having a cylindrical interior surface and a cylindrical exterior surface in engagement with the interior surface of the fluid channel, and a projection projecting from the orifice wall into the conduit, the orifice extending through and being centered in the projection and the projection being centered in the conduit; and, a fluid spinner assembly contained in the conduit, the spinner assembly having a spinner head with axially opposite first and second end faces and an annular wall projecting an axial distance from the first end face and forming a swirl chamber at the first end face, the annular wall having an interior surface that surrounds the swirl chamber and the projection on the orifice wall, and the annular wall having a distal end surface that engages with the orifice wall around the projection where the axial distance of the annular wall's projection from the first end face spaces the orifice wall projection from the first end face of the spinner head.

2. The apparatus of claim 1, wherein:

the projection on the orifice wall has a cylindrical exterior surface with a first circumferential measure and the interior surface of the annular wall is cylindrical and has a second circumferential measure that is smaller than the first circumferential measure where the difference in the circumferences of the projection and the annular wall interior surface produce a sealing interference fit of the annular wall interior surface around the projection.

3. The sprayer apparatus of claim 1, wherein:

the orifice wall projection has a first circumferential dimension and the interior surface of the spinner head annular wall has a second circumferential dimension that is slightly larger than the first circumferential dimension.

4. The sprayer apparatus of claim 3, wherein:

the interior surface of the nozzle head conduit has a third circumferential dimension and the exterior surface of the spinner head annular wall has a fourth circumferential dimension smaller than the third circumferential dimension.

5. The sprayer apparatus of claim 1, wherein:

at least one tangential groove extends through the annular wall of the spinner head between the exterior surface and the interior surface of the annular wall, the tangential groove bypasses the engagement of the annular wall distal end surface with the orifice wall and bypasses the orifice wall projection surrounded by the annular wall thereby providing fluid communication between the fluid channel of the sprayer housing and the swirl chamber of the spinner head through the tangential groove.

6. The sprayer apparatus of claim 1, wherein:

the fluid spinner assembly includes means for interacting with the nozzle head conduit to maintain the distal end surface of the spinner head annular wall in engagement with the nozzle head orifice wall.

7. The sprayer apparatus of claim 6, wherein:

the means for interacting with the nozzle head conduit includes at least a pair of radial spines on the spinner head that engage against the interior surface of the nozzle head conduit.

8. The sprayer apparatus of claim 1, wherein:

the sprayer housing fluid channel has a valve seat at the second end of the channel; and the spinner assembly comprises a priming valve connected to the spinner head by a spring, the priming valve engages against the valve seat of the fluid channel to control fluid flow through the inlet and the spring biases the distal end surface of the spinner head annular wall into engagement with the nozzle head orifice wall, 9. The sprayer apparatus of claim 1, wherein:

the sprayer housing fluid channel has a valve seat at the second end of the channel; and, the spinner assembly comprises a disk valve connected to the second end face of the spinner head, the disk valve engages against the valve seat of the fluid channel to control fluid flow through the inlet and holds the distal end surface of the spinner head annular wall in engagement with the nozzle head orifice wall.

10. The sprayer apparatus of claim 1, wherein:

the nozzle head orifice wall is a flat surface extending radially between the orifice wall projection and the orifice wall conduit interior surface.

11. A trigger sprayer apparatus comprising:

a sprayer housing having a longitudinal liquid channel extending therethrough, the channel having a liquid outlet opening;

a head member on the sprayer housing, the head member having an orifice wall positioned proximate to the liquid outlet opening of the liquid channel, the orifice wall having a face surface and a fluid discharge orifice extending longitudinally through the orifice wall to the face surface, the head member has a tubular sleeve that surrounds the orifice and extends longitudinally from the orifice wall through the liquid outlet opening and into the liquid channel of the sprayer housing; and, a fluid spinner within the liquid channel, the spinner having an end wall proximate to the orifice wall and a swirl chamber adjacent the end wall, the swirl chamber is surrounded by an annular wall that projects longitudinally from the spinner end wall to an annular end face of the annular wall, the head member tubular sleeve surrounds the annular wall of the swirl chamber, and the annular wall has an interior surface that surrounds the orifice and defines a volume of the swirl chamber bounded by the spinner end wall, the interior surface of the annular wall, and the face surface of the orifice the interior volume of the swirl chamber imparting a spin to liquid passed through the swirl chamber, resulting in a spray of liquid being discharged from the discharge orifice.

12. The apparatus of claim 11, wherein:

the annular end face of the annular wall engages in sealing contact with the orifice wall around the orifice.

13. The apparatus of claim 4, wherein:

the tubular sleeve has a tapered portion adjacent the orifice wall and the tapered portion of the sleeve engages in contact with the annular wall of the spinner centering the spinner around the orifice.

14. The apparatus of claim 13, wherein:

the spinner annular wall has a minimum exterior circumference and the tapered portion of the member head sleeve has a minimum interior circumference that is larger than the minimum exterior circumference of the annular wall providing a clearance between the annular wall and the sleeve tapered portion that allows the annular end face of the annular wall to engage in sealing contact with the orifice wall around the orifice without interference from contact between the annular wall and the sleeve tapered portion.

15. The apparatus of claim 1, wherein:

at least one groove extends through the annular wall and opens through the annular wall interior surface into the swirl chamber between the orifice wall face surface and the spinner end wall.

16. The apparatus of claim 15, wherein:

the one groove is a tangential groove.

17. The apparatus of claim 11, wherein:

a spring having opposite ends and a priming valve are contained in the liquid channel, one end of the spring acts against the priming valve and biases the priming valve into engagement with a valve seat at one end of the sprayer housing channel, and the opposite end of the spring acts against the fluid spinner and biases the annular end face of the spinner annular wall in sealing contact with the orifice wall around the orifice.

18. The apparatus of claim 11, wherein:

an incompressible stem extends longitudinally from the fluid spinner to a disk valve connected to the stem, the disk valve is engaged in a valve seat at one end of the sprayer housing liquid channel, and the stem maintains sealing contact of the spinner wall annular end face with the orifice wall around the orifice.

19. The apparatus of claim 11, wherein:

a stem extends longitudinally from the fluid spinner through the interior of the member head sleeve, and at least one radial spine projects laterally from the stem and engages against an interior surface of the sleeve.

20. The apparatus of claim 11, wherein:

the orifice wall has a cylindrical projection that extends longitudinally from the orifice wall to a distal end of the projection, the face surface of the orifice wall is on the distal end of the orifice wall projection, and the discharge orifice extends longitudinally through the orifice wall and through the orifice wall projection to the face surface.

21. The apparatus of claim 20, wherein:

the interior surface of the annular wall engages in sealing contact around the orifice wall projection.

22. The apparatus of claim 20, wherein:

the cylindrical projection on the orifice wall has a first circumference and the interior surface of the spinner annular wall has a second circumference that is slightly smaller than the first circumference where the difference in the circumferences of the projection and annular wall interior surface produce a sealing interference fit of the annular wall interior surface around the orifice wall projection.

23. The apparatus of claim 1, wherein:

the fluid spinner is formed separately from the sprayer housing.

24. The apparatus of claim 11, wherein:

the trigger sprayer discharges a nonvariable liquid spray pattern.

25. The apparatus of claim 11, wherein:

the liquid channel has an inlet opening and a control valve at the inlet opening, the fluid spinner is operatively connected to the control valve and resists opening of the control valve except in response to liquid pressure exerted on the control valve.

26. A trigger sprayer apparatus comprising:

a sprayer housing having a longitudinal liquid channel extending therethrough, the channel having longitudinally opposite first and second ends with a liquid outlet opening at the first end and a liquid inlet opening at the second end;

a nozzle head on the sprayer housing, the nozzle head having an orifice wall positioned proximate to the fluid outlet opening of the liquid channel, the orifice wall having a cylindrical projection that extends longitudinally from the orifice wall to a face surface of the projection, a liquid discharge orifice having a continuous interior bore extends longitudinally through the orifice wall and through the projection to the face surface of the projection, and a tubular sleeve surrounds the projection and extends longitudinally from the orifice wall, the sleeve has an interior surface that tapers as the interior surface extends toward the orifice wall; and a fluid spinner is contained in the liquid channel and the nozzle head sleeve, the spinner has an end wall proximate to the orifice wall and a swirl chamber adjacent the end wall, the swirl chamber is surrounded by an annular wall that projects longitudinally from the spinner end wall to an annular end face of the annular wall, the annular wall has an interior surface that surrounds the orifice wall projection, and the annular wall has an exterior surface that engages with the tapered interior surface of the nozzle head sleeve whereby the tapered interior surface of the nozzle head sleeve centers the spinner annular wall around the orifice wall projection.

27. The apparatus of claim 26, wherein:

the fluid spinner is positioned in the nozzle head sleeve by passing the spinner through the sleeve toward the orifice wall with the sleeve tapered interior surface engaging against the spinner annular wall and centering the annular wall around the orifice wall projection.

28. The apparatus of claim 27, wherein:

the spinner annular wall has a minimum exterior circumference and the tapered interior surface of the nozzle head sleeve has a minimum interior circumference that is larger than the minimum exterior circumference of the annular wall providing a clearance between the annular wall and the tapered interior surface that allows the interior surface of the annular wall to pass over the orifice wall projection and the annular end face of the annular wall to engage in sealing contact with the orifice wall without interference from contact between the annular wall and the tapered interior surface of the sleeve.

29. The apparatus of claim 26, wherein:

the cylindrical projection on the orifice wall has a first exterior circumference and the interior surface of the spinner annular wall has a second interior circumference that is slightly smaller than the first exterior circumference where the difference in the circumferences of the projection and annular wall interior surface produce a sealing interference fit of the annular wall interior surface around the orifice wall projection.

30. The apparatus of claim 26, wherein:

the tubular sleeve of the nozzle head extends from the orifice wall through the outlet opening and into the liquid channel of the sprayer housing.

31. The apparatus of claim 26, wherein:

at least one groove extends through the annular wall and opens through the annular wall interior surface into the swirl chamber between the projection face surface and the spinner end wall.

32. A trigger sprayer comprising:

a sprayer housing having a liquid channel extending axially therethrough, the channel having opposite first and second ends with a liquid outlet opening at the first end and a liquid inlet opening at the second end;

a nozzle head assembled to the first end of the sprayer housing channel, the nozzle head having an orifice wall with a liquid discharge orifice extending axially therethrough and a projection projecting from the orifice wall, the orifice extending through and being centered in the projection; and, a fluid spinner contained in the liquid channel, the spinner having a spinner head with an end face and an annular wall projecting an axial distance from the end face and forming a swirl chamber at the end face, the annular wall having an interior surface that surrounds the swirl chamber and the projection on the orifice wall, and the annular wall having a distal end surface that engages with the orifice wall around the projection where the axial distance of the annular wall's projection from the end face spaces the orifice wall projection from the end face of the spinner head.

33. The apparatus of claim 32, wherein:

the projection on the orifice wall has a cylindrical exterior surface with a first circumference and the interior surface of the annular wall is cylindrical and has a second circumference that is smaller than the first circumference where the difference in the circumferences of the projection and the annular wall interior surface produce a sealing interference fit of the annular wall interior surface around the projection.

34. The sprayer apparatus of claim 22, wherein:

the orifice wall projection has a first circumferential dimension and the interior surface of the spinner head annular wall has a second circumferential dimension that is slightly larger than the first circumferential dimension.

35. The sprayer apparatus of claim 32, wherein:

at least one tangential groove extends through the annular wall of the spinner head, the tangential groove bypasses the engagement of the annular wall distal end surface with the orifice wall and bypasses the orifice wall projection surrounded by the annular wall thereby providing fluid communication between the liquid channel of the sprayer housing and the swirl chamber of the spinner head through the tangential groove.

36. The sprayer apparatus of claim 32, wherein:

a tubular sleeve projects from the orifice wall through the liquid channel outlet opening and into the fluid channel, and the fluid spinner includes at least a pair of radial spines on the spinner head that engage against the sleeve to maintain the distal end surface of the spinner head annular wall in engagement with the nozzle head orifice wall.

37. The sprayer apparatus of claim 32, wherein:

the sprayer housing liquid channel has a valve seat at the second end of the channel; and the spinner comprises a priming valve connected to the spinner head by a spring, the priming valve engages against the valve seat of the liquid channel to control fluid flow through the inlet and the spring biases the distal end surface of the spinner head annular wall into engagement with the nozzle head orifice wall.

38. The sprayer apparatus of claim 32 wherein:

the sprayer housing liquid channel has a valve seat at the second end of the channel; and, the spinner comprises a disk valve connected to the spinner head, the disk valve engages against the valve seat of the liquid channel to control liquid flow through the inlet and holds the distal end surface of the spinner head annular wall in engagement with the nozzle head orifice wall.

* * * * *

UNITED STATES PATENT AND TRADEMARK OFFICE

CERTIFICATE OF CORRECTION

PATENT NO. : 5,549,249

DATED : August 27, 1996

INVENTOR(S) : Foster et al.

It is certified that error appears in the above-indentified patent and that said Letters Patent is hereby corrected as shown below:

On the title page, item [54], and Col. 1, line 3, In the title of the invention, replace "FLOOD" with --FLOW--.

In column 10, line 16, replace "4" with --11--.

In column 11, line 13, replace "1" with --11--.

In column 12, line 59, replace "22" with --32--.

Signed and Sealed this

Seventh Day of January, 1997

*Attest:*

BRUCE LEHMAN

*Attesting Officer*

*Commissioner of Patents and Trademarks*